US009450341B2

(12) United States Patent
Kao et al.

(10) Patent No.: US 9,450,341 B2
(45) Date of Patent: Sep. 20, 2016

(54) ELECTRICAL PLUG CONNECTOR

(71) Applicant: Advanced-Connectek Inc., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Yang-Yang Zhou, New Taipei (TW)

(73) Assignee: Advanced-Connectek, Inc., New Taipei (TW)

( * ) Notice: Subject to any disclaimer, the term of this patent is extended or adjusted under 35 U.S.C. 154(b) by 0 days.

(21) Appl. No.: 14/947,405

(22) Filed: Nov. 20, 2015

(65) Prior Publication Data

US 2016/0156136 A1 Jun. 2, 2016

(30) Foreign Application Priority Data

Nov. 27, 2014 (CN) ..... 2014 1 0695661

(51) Int. Cl.

| | |
|---|---|
| ***H01R 24/00*** | (2011.01) |
| ***H01R 13/6585*** | (2011.01) |
| ***H01R 24/60*** | (2011.01) |
| *H01R 107/00* | (2006.01) |

(52) U.S. Cl.

CPC ..... *H01R 13/6585* (2013.01); *H01R 24/60* (2013.01); *H01R 2107/00* (2013.01)

(58) Field of Classification Search

CPC ..... H01R 23/02; H01R 24/60; H01R 24/62

USPC ..... 439/660, 218, 607.11, 607.08

See application file for complete search history.

(56) References Cited

U.S. PATENT DOCUMENTS

| | | | | |
|---|---|---|---|---|
| 8,784,123 | B1 * | 7/2014 | Leiba | H01R 27/00 439/218 |
| 8,851,927 | B2 * | 10/2014 | Hsu | H01R 13/6594 439/607.11 |
| 8,882,524 | B2 * | 11/2014 | Golko | H01R 13/6273 439/218 |
| 9,142,926 | B2 * | 9/2015 | Tsai | H01R 24/60 |
| 2015/0244111 | A1 * | 8/2015 | Ju | H01R 13/6585 439/607.05 |

* cited by examiner

*Primary Examiner* — Phuong Dinh

(74) *Attorney, Agent, or Firm* — C. G. Mersereau; Nikolai & Mersereau, P.A.

(57) ABSTRACT

An electrical plug connector has an insulative housing, two terminal sets, a shielding-grounding plate and a shell. The terminal sets are mounted in the insulative housing and each terminal set has multiple conductive terminals. The shielding-grounding plate is mounted in a rear end of the insulative housing and has a shielding body mounted in the rear end of the insulative housing and located between the terminal sets and two resilient hooking arms formed on and protruding forward respectively from two opposite sides of the shielding body and extending in the insulative housing. The shielding-grounding plate is located above the conductive terminals of the two terminal sets and shields the terminal sets such that each terminal set would not interfere with the other terminal set with cross talk when implementing signal transmission.

11 Claims, 9 Drawing Sheets

ELECTRICAL PLUG CONNECTOR

BACKGROUND OF THE INVENTION

1. Field of the Invention

The present invention relates to an electrical connector, and more particularly to an electrical plug connector that has a grounding plate set between two sets of terminals to prevent cross talk between the sets of the terminals. Furthermore, the grounding plate is incorporated integrally with resilient hooking arms for providing excellent hooking ability to a corresponding receptacle connector.

2. Description of Related Art

Electrical connectors are common electrical components mounted on electronic devices and may be connected to corresponding electrical connectors on other electrical devices for signal transmission or power supply between the connected electrical devices.

A conventional electrical connector such as a universal serial bus (USB) 3.0 electrical plug connector has an insulative housing, two sets of terminals and a metal shell. The sets of the terminals are mounted on the insulative housing. The shell covers and accommodates the insulative housing and the terminals. However, no shielding element is mounted between the sets of the terminals. Therefore, interference of crosstalk easily occurs when the sets of the terminals are implementing signal transmission, which decreases the stability of signal transmission and the transmission efficiency.

Furthermore, the conventional electrical connector lacks hooking elements to firmly engage a corresponding electrical connector.

To overcome the shortcomings, the present invention provides an electrical plug connector to mitigate or obviate the aforementioned problems.

SUMMARY OF THE INVENTION

The main objective of the invention is to provide an electrical plug connector that has a grounding plate set between two sets of terminals to prevent cross talk between the sets of the terminals. Furthermore, the grounding plate is incorporated integrally with resilient hooking arms for providing excellent hooking ability to a corresponding receptacle connector.

An electrical plug connector in accordance with the present invention comprises an insulative housing, two terminal sets, a shielding-grounding plate and a shell. The terminal sets are mounted in the insulative housing and each terminal set has multiple conductive terminals. The shielding-grounding plate is mounted in a rear end of the insulative housing and has a shielding body mounted in the rear end of the insulative housing and located between the terminal sets and two resilient hooking arms formed on and protruding forward respectively from two opposite sides of the shielding body and extending in the insulative housing. The shielding-grounding plate is located on the conductive terminals of the two terminal sets and shields the terminal sets such that each terminal set would not interfere with the other terminal set with cross talk when implementing signal transmission.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
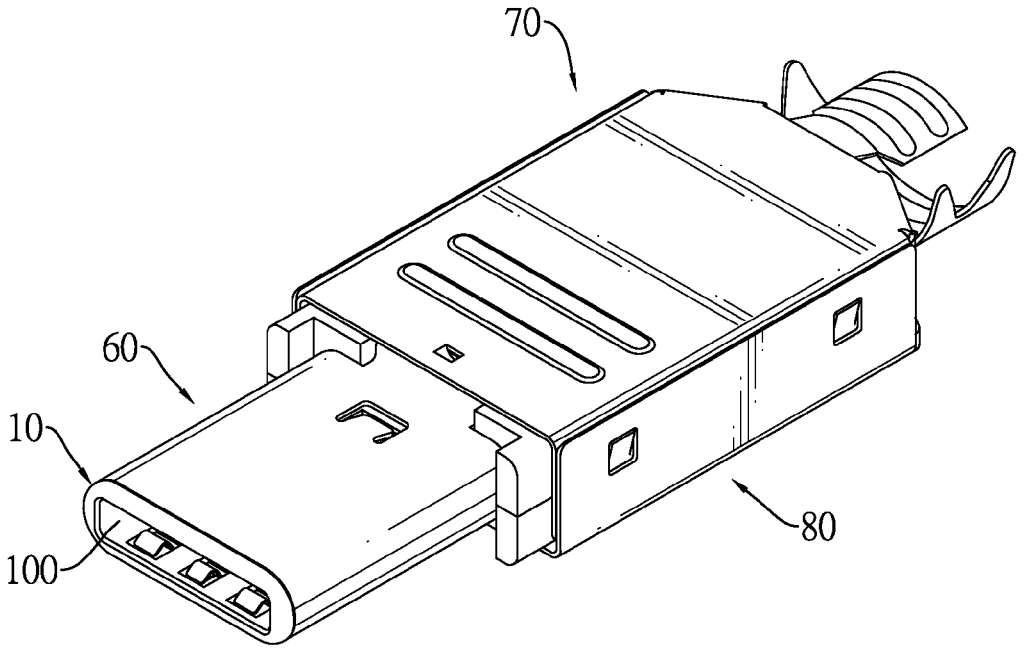
FIG. 1 is a perspective view of an electrical plug connector in accordance with the present invention.
Figure 2:
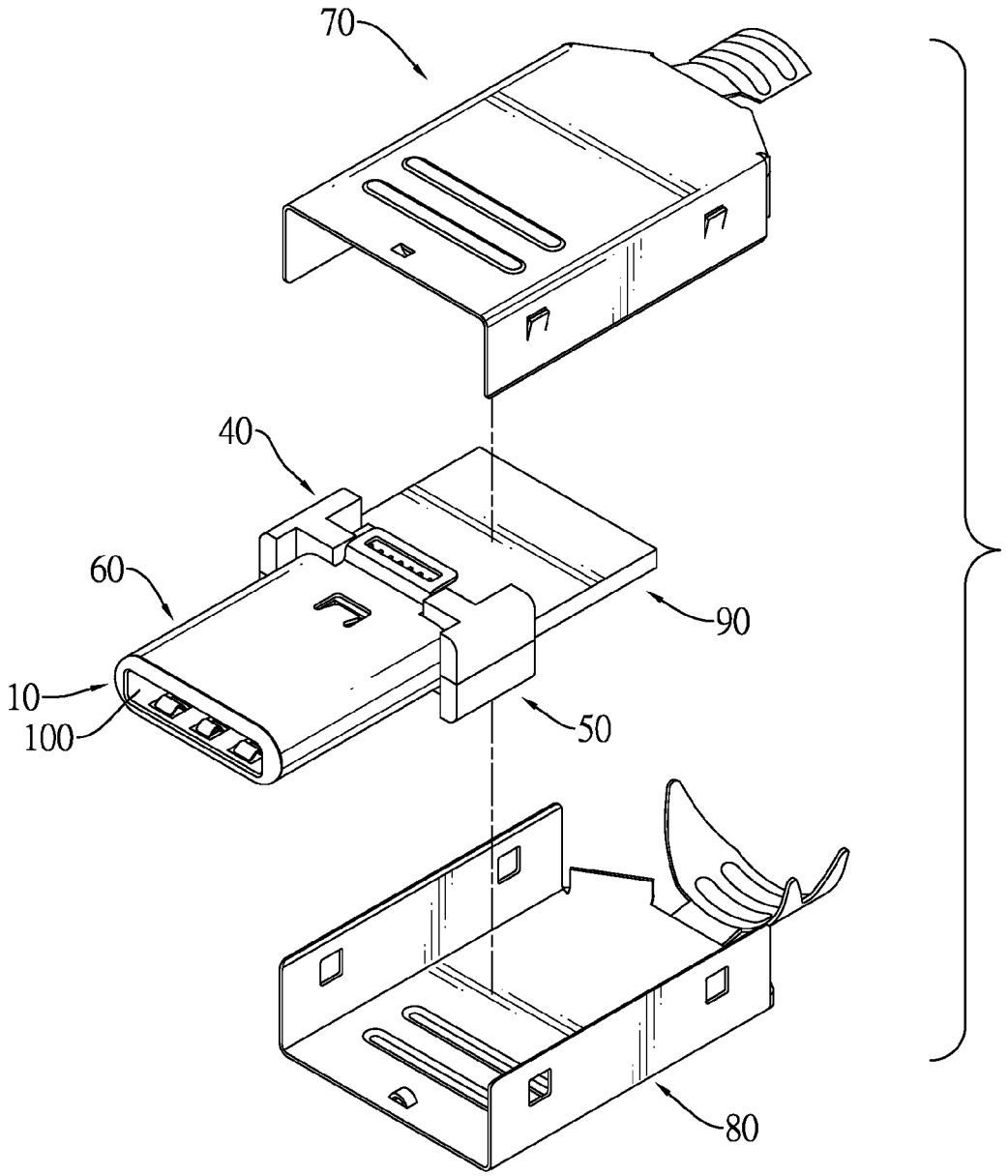
FIG. 2 is an exploded perspective view of the electrical plug connector in FIG. 1.

With reference to FIGS. 1 and 2, an electrical plug connector in accordance with the present invention may be a USB Type-C connector, and complies with the USB Type-C Cable and Connector Specification ver. 0.98C set by the USB implementers Forum (USB IF).

Figure 3:
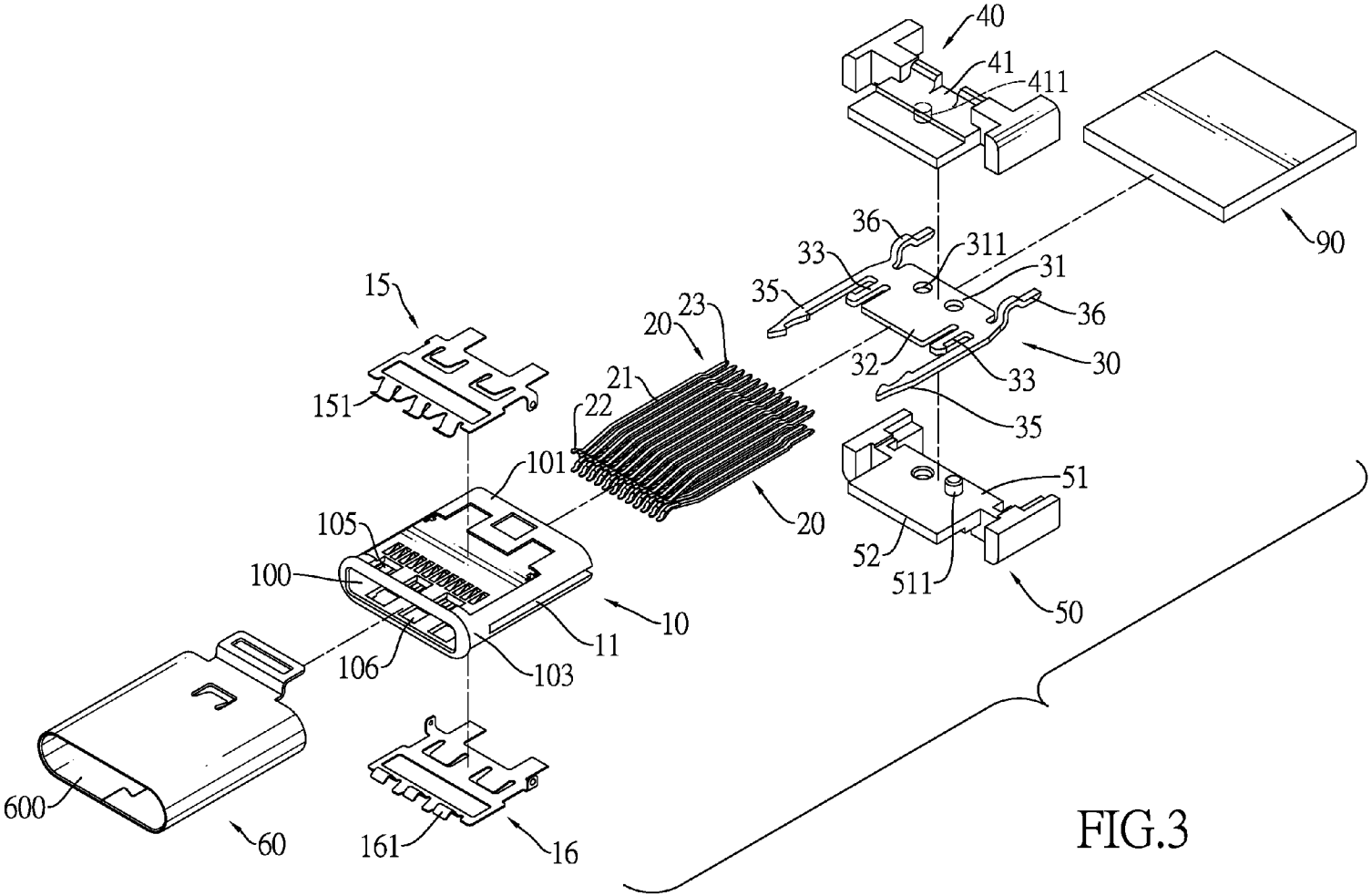
FIG. 3 is an exploded perspective view of the electrical plug connector in FIG. 1 without an upper shielding cover and a lower shielding cover.
Figure 4:
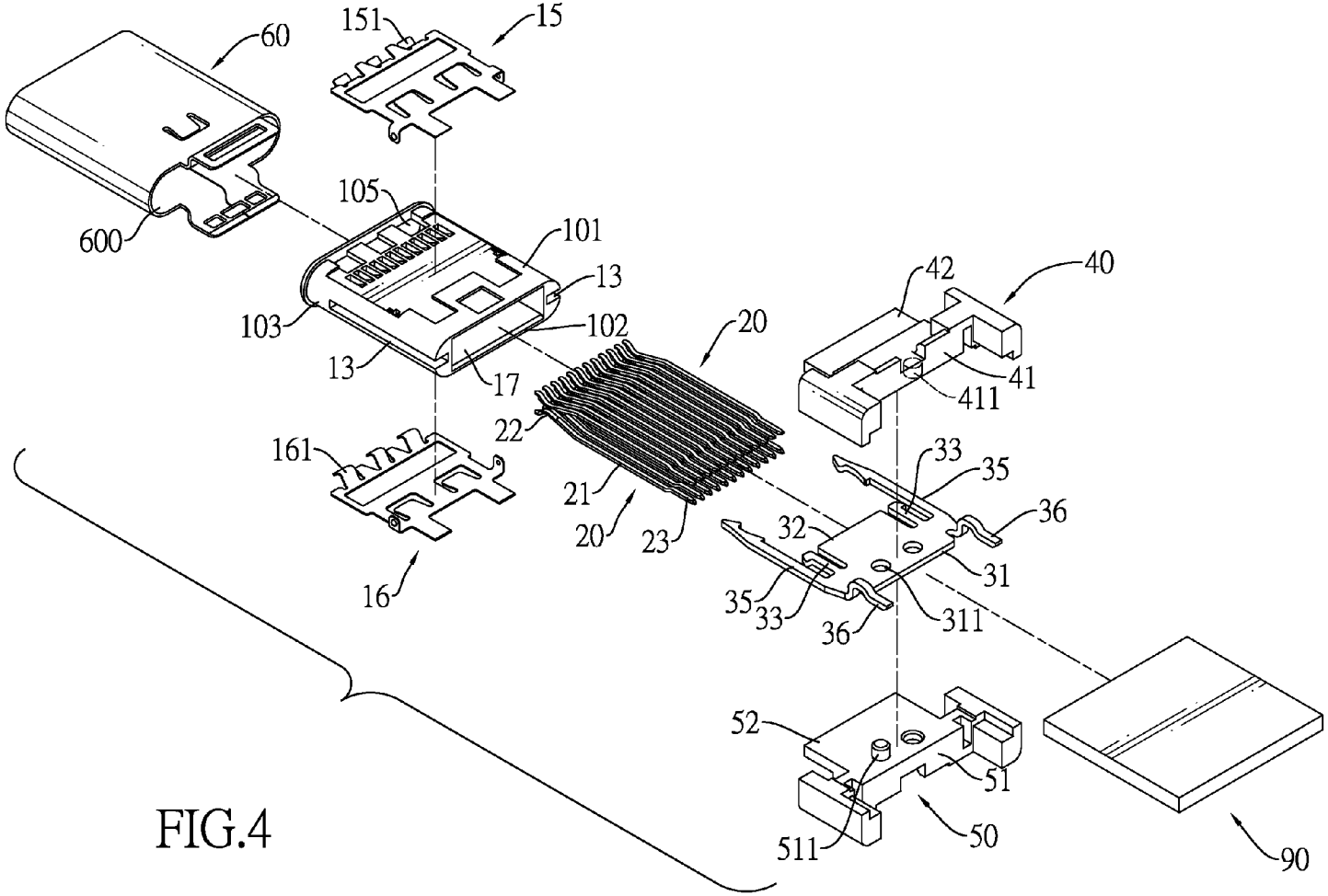
FIG. 4 is another exploded perspective view of the electrical plug connector in FIG. 1 without the upper shielding cover and the lower shielding cover.

With further reference to FIGS. 3 and 4, the electrical plug connector comprises an insulative housing 10, two terminal sets, a shielding-grounding plate 30, an upper rear plug bracket 40, a lower rear plug bracket 50, a shell 60, a circuit board 90, an upper shielding cover 70 and a lower shielding cover 80.

The insulative housing 10 is substantially horizontally symmetrical and has a top board 101, a bottom board 102, two opposite sidewalls 103, an insertion space 100, an assembling slot 17, two positioning slots 11, an upper pressing element 15 and a lower pressing element 16.

The top board 101 has multiple upper terminal recesses 1010 and multiple upper through holes 105. The upper terminal recesses 1010 are defined in an upper inner surface of the top board 101. The upper through holes 105 are defined through the top board 101 and communicate with the insertion space 100.

The bottom board 102 has multiple lower terminal recesses 1020 and multiple lower through holes 106. The lower terminal recesses 1020 are defined in a lower inner surface of the bottom board 102. The lower through holes 106 are defined through the bottom board 102 and communicate with the insertion space 100.

The sidewalls 103 are located between the top board 101 and the bottom board 102.

The insertion space 100 is defined in a front end of the insulative housing 10 among the top board 101, the bottom board 102 and the sidewalls 103.

The assembling slot 17 is defined in a rear end of the insulative housing 10 and has two opposite hooking notches 171 defined respectively in two opposite inner walls of the assembling slots 17.

The positioning slots 11 are defined through the sidewalls 103 and communicate with the insertion space 100.

The upper pressing element 15 is mounted on the top board 101 and has multiple upper resilient pressing tabs 151 formed on the upper pressing element 15 and respectively extending through the upper through holes 105 into the insertion space 100.

The lower pressing element 16 is mounted on the bottom board 102 and has multiple lower resilient pressing tabs 161 formed on the lower pressing element 16 and respectively extending through the lower through holes 106 into the insertion space 100.

The terminal sets are substantially point symmetrical to each other according to a centre of symmetry of the insertion space 100. According to point symmetrical configuration of the terminal sets, when the terminal sets are rotated for 180 degrees according to the centre of symmetry, the rotated terminal sets coincide and are identical with the terminal sets without rotation of 180 degrees. By the point symmetrical configuration of the terminal sets, the electrical plug connector is able to extend reversely into a corresponding receptacle connector to normally implement high speed signal transmission. The terminal sets are mounted respectively on the upper inner surface of the top board 101 and the lower inner surface of the bottom board 102.

Each terminal set has multiple conductive terminals 20. The conductive terminals 20 of one terminal set are mounted respectively in the upper terminal recesses 1010 of the top board 101 of the insulative housing 10, and the conductive terminals 20 of the other terminal set are mounted respectively in the lower terminal recesses 1020 of the bottom board 102 of the insulative housing 10. Each conductive terminal 20 has a mounting section 21, an electrical contacting section 22 and a soldering section 23. The mounting section 21 is mounted on the top board 101 or the bottom board 102 of the insulative housing 10. The electrical contacting section 22 is formed on and protrudes forward from the mounting section 21 and extends in the insertion space 100. The soldering section 23 is formed on and protrudes backward from the mounting section 21. The electrical contacting sections 22 of one terminal set are arranged in an upper row, and the electrical contacting sections 22 of the other terminal set are arranged in a lower row aligned with the upper row. The soldering sections 23 of one terminal set are arranged in an upper row, and the soldering sections 23 of the other terminal set are arranged in a lower row aligned with the upper row. Furthermore, each terminal set may be mounted in the top board 101 or the bottom board 102 of the insulative housing by an insert-molding process or other assembling process.

Figure 5:
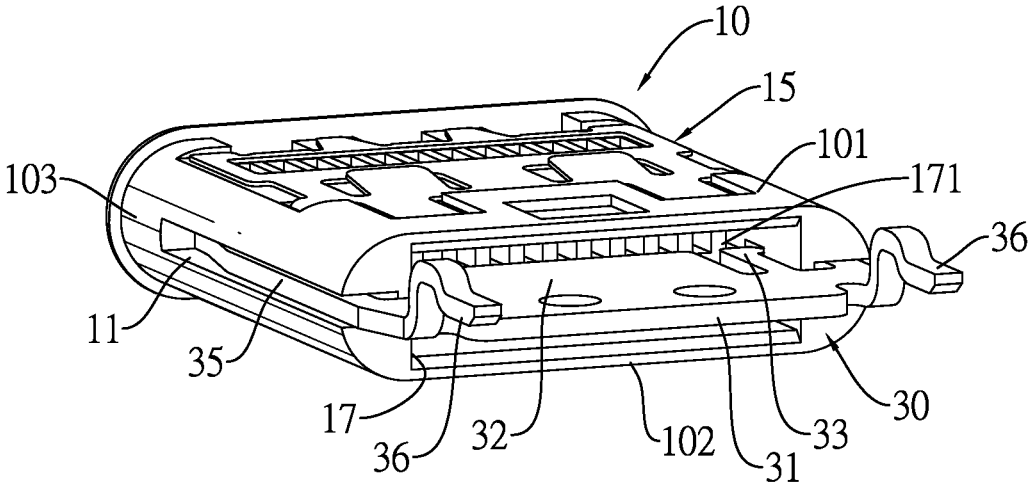
FIG. 5 is a perspective view of an insulative housing and a shielding-grounding plate of the electrical plug connector in FIG. 1.
Figure 6:
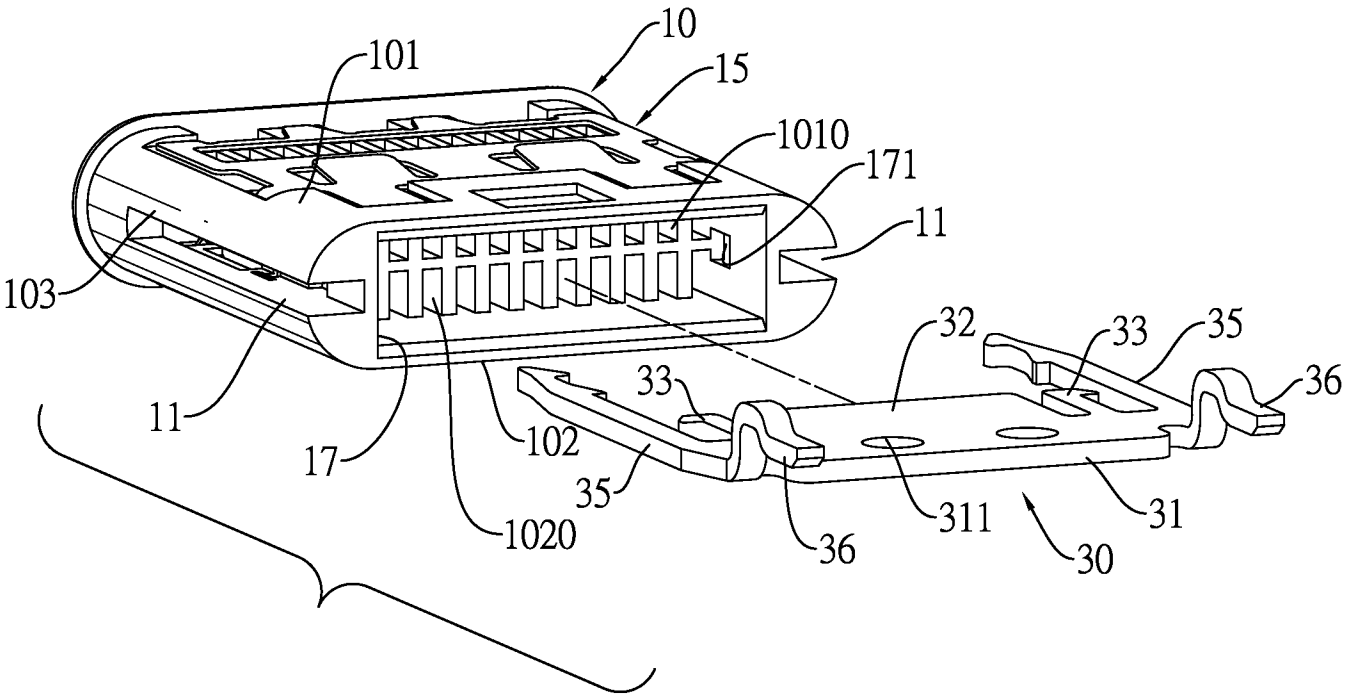
FIG. 6 an exploded perspective view of an insulative housing and a shielding-grounding plate of the electrical plug connector in FIG. 3.
Figure 7:
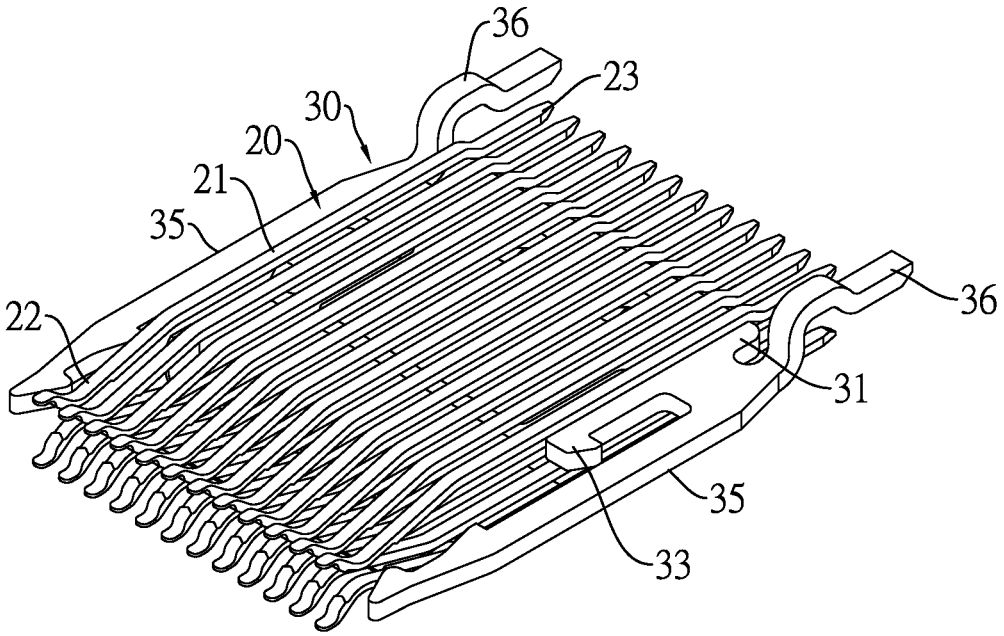
FIG. 7 is a perspective view of two sets of terminals and the shielding-grounding plate of the electrical plug connector in FIG. 3.
Figure 8:
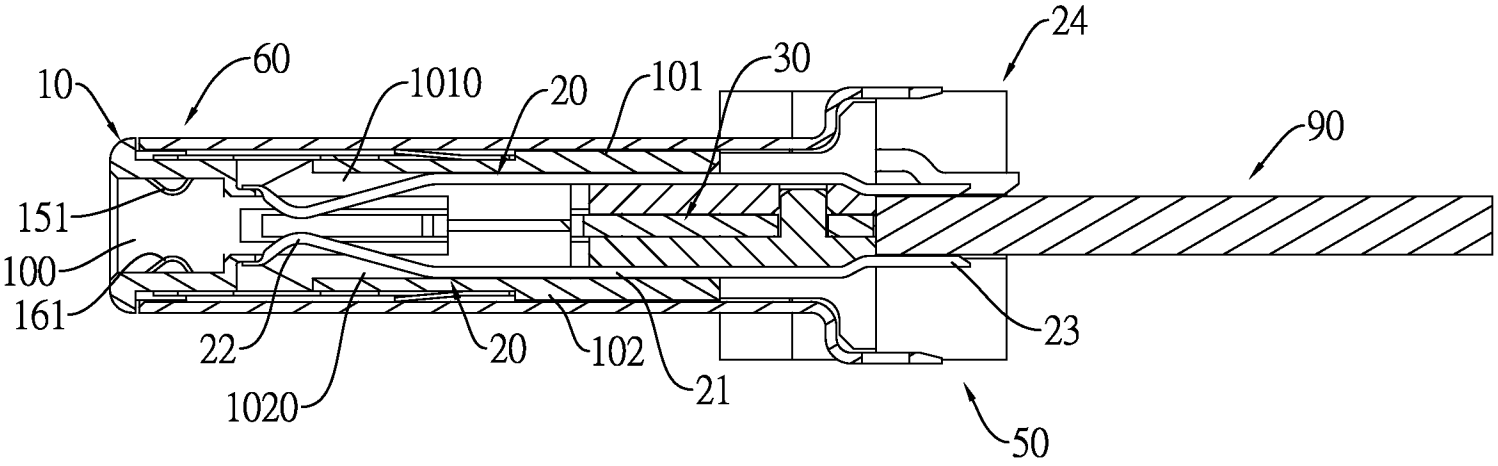
FIG. 8 is a cross sectional side view of the electrical plug connector in FIG. 1 without the upper shielding cover and the lower shielding cover.

With further reference to FIGS. 5 to 7, the shielding-grounding plate 30 is mounted in the rear end of the insulative housing 10, may be mounted in the assembling slot 17 of the insulative housing 10 and has a shielding body 31, an extension shielding sheet 32, two resilient hooking arms 35, two fastening elements 33 and two soldering tabs 36.

The shielding body 31 is mounted in the rear end of the insulative housing 10, is located between the two terminal sets, may be located between the mounting sections 21 of the conductive terminals 20 of the two terminal sets and has two mounting holes 311 defined through the shielding body 31.

The extension shielding sheet 32 is formed on and protrudes forward from the shielding body 31, is mounted in the rear end of the insulative housing 10, may be mounted in the assembling slot 17 of the insulative housing 10 and is located between the mounting sections of the conductive terminals 20 of the two terminal sets.

The resilient hooking arms 35 are formed on and protrude forward respectively from two opposite sides of the shielding body 31 and extend in the insertion space 100 of the insulative housing 10 for firmly clamping and holding a corresponding electrical receptacle connector engaged with the electrical plug connector such that an inadvertent disengagement of the electrical plug connector from the electrical receptacle connector is prevented. Furthermore, the resilient hooking arms 35 may be mounted respectively in the positioning slots 11 of the insulative housing 10.

The fastening elements 33 are formed on and protrude forward from the shielding body 31 and are engaged respectively with the hooking notches 171 of the insulative housing 10. Each fastening element 33 is located between the extension shielding sheet 32 and one of the resilient hooking arms 35.

The soldering tabs 36 are formed on and protrude backward from the shielding body 31.

Figure 9:
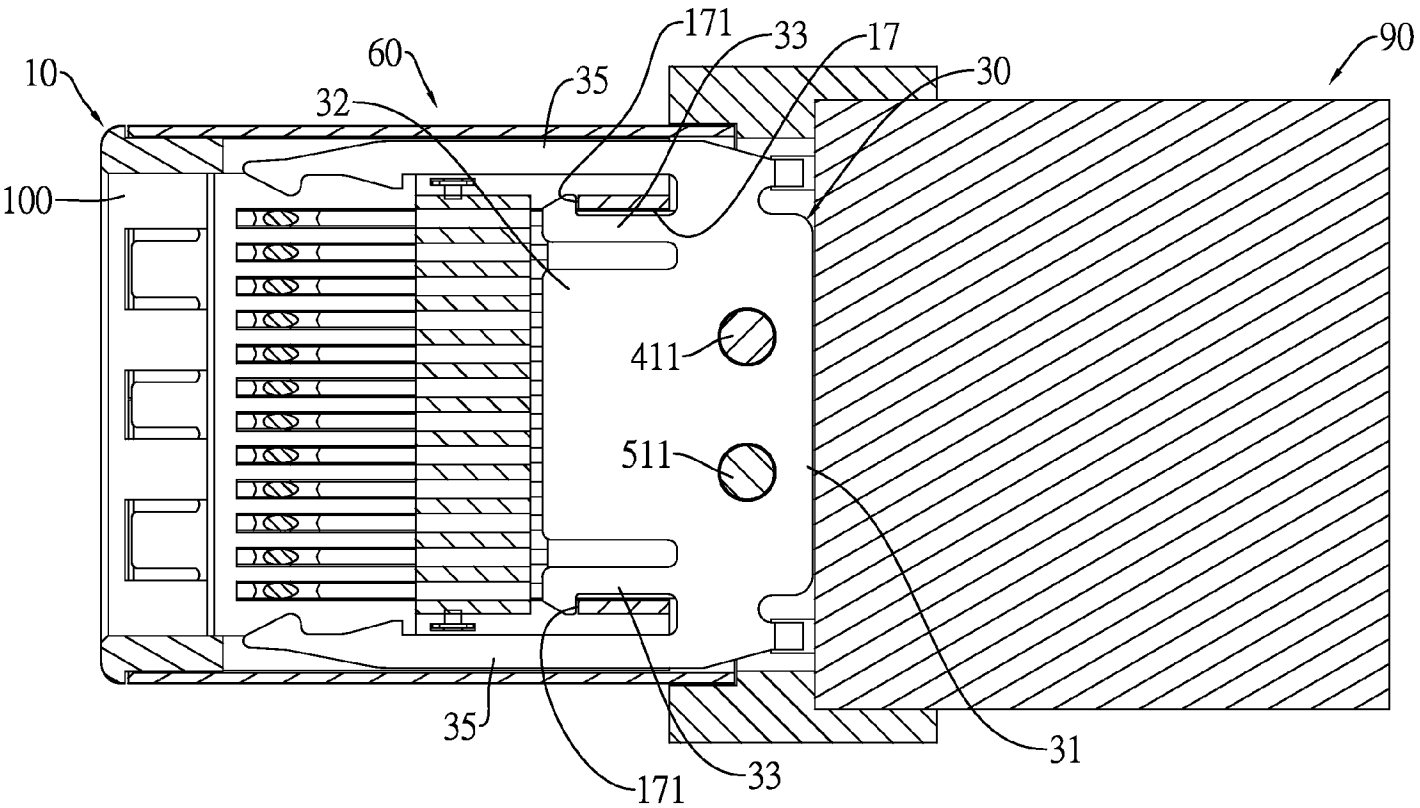
FIG. 9 is a cross sectional top view of the electrical plug connector in FIG. 1 without the upper shielding cover and the lower shielding cover.

With further reference to FIG. 9, the upper rear plug bracket 40 is mounted on the rear end of the insulative housing 10, is mounted above the shielding-grounding plate 30 and has an upper mounting bracket 41, an upper inserting board 42 and an upper mounting protrusion 411.

The upper inserting board 42 is formed on and protrudes forward from the upper mounting bracket 41 and is mounted in the assembling slot 17 of the insulative housing 10.

The upper mounting protrusion 411 is formed on and protrudes downward from the upper mounting bracket 41 and is mounted in one of the mounting holes 311 of the shielding body 31 of the shielding-grounding plate 30.

The lower rear plug bracket 50 is mounted on the rear end of the insulative housing 10, is mounted under the shielding-grounding plate 30 and has a lower mounting bracket 51, a lower inserting board 52 and a lower mounting protrusion 511.

The lower inserting board 52 is formed on and protrudes forward from the lower mounting bracket 51 and is mounted in the assembling slot 17 of the insulative housing 10.

The lower mounting protrusion 511 is formed on and protrudes upward from the lower mounting bracket 51 and is mounted in the other mounting hole 311 of the shielding body 31 of the shielding-grounding plate 30.

The shell 60 is made of metal, is substantially horizontally symmetrical and has a cavity 600 defined in the shell 60 and accommodating the insulative housing 10.

The circuit board 90 is mounted on the rear end of the insulative housing 10 and has two opposite surfaces respectively connected to the soldering sections 23 of the conductive terminals 20 of the two terminal sets by soldering. One of the opposite surfaces is connected to the soldering tabs 36 of the shielding-grounding plate 30 by soldering for grounding purposes.

The upper shielding cover 70 and the lower shielding cover 80 cooperate to cover the insulative housing 10, the terminal sets, the upper rear plug bracket 40, the lower rear plug bracket 50 and the circuit board 90.

The electrical plug connector has the following advantages.

1. The shielding-grounding plate 30 is located above the conductive terminals 20 of the two terminal sets and shields the terminal sets such that each terminal set would not interfere with the other terminal set with cross talk when implementing signal transmission. Therefore, efficiency of signal transmission is improved. Furthermore, the shielding-grounding plate 30 also serves as a grounding terminal to dissipate static electricity on the electrical plug connector such that noise during signal transmission is further decreased.

2. The resilient hooking arms 35 formed integrally on the shielding-grounding plate 30 provide excellent hooking force to effectively prevent the electrical plug connector from inadvertently disengaging from the corresponding electrical receptacle connector.

3. The extension shielding sheet 32 further increases the length and the area of the shielding-grounding plate 30 and effectively partitions the mounting sections 21 of the conductive terminals 20 of the terminal sets, which further improves the shielding effect to prevent interference of cross talk between the terminal sets.

4. The upper rear plug bracket 40 and the lower rear plug bracket 50 are mounted simultaneously on the insulative housing 10 and the shielding-grounding plate 30, which improves the structural strength of the electrical plug connector.

5. The electrical plug connector complies with the USB Type-C standard and has the horizontally symmetrical insulative housing 10, the horizontally symmetrical shell 60 and the point symmetrical terminal sets based on the centre of symmetry of the insertion space 100. Therefore, the electrical plug connector is able to be normally or reversely engaged with the corresponding receptacle connector without any additional foolproof structures.

6. The upper shielding cover 70 and the lower shielding cover 80 further shield the terminals set from being interfered with external noise.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical plug connector comprising:

an insulative housing having a top board, a bottom board, two opposite sidewalls and an insertion space defined in a front end of the insulative housing among the top board, the bottom board and the sidewalls;

two terminal sets being substantially point symmetrical to each other according to a centre of symmetry of the insertion space, and mounted respectively on an upper inner surface of the top board and a lower inner surface of the bottom board, wherein each terminal set has multiple conductive terminals and each conductive terminal has a mounting section mounted on the top board or the bottom board of the insulative housing;

an electrical contacting section formed on and protruding forward from the mounting section and extending in the insertion space; and a soldering section formed on and protruding backward from the mounting section, wherein the electrical contacting sections of one of the terminal sets are arranged in an upper row, and the electrical contacting sections of the other terminal set are arranged in a lower row aligned with the upper row, wherein the soldering sections of one terminal set are arranged in an upper row, and the soldering sections of the other terminal set are arranged in a lower row aligned with the upper row;

a shielding-grounding plate mounted in a rear end of the insulative housing and having a shielding body mounted in the rear end of the insulative housing and located between the terminal sets; and two resilient hooking arms formed on and protruding forward respectively from two opposite sides of the shielding body and extending in the insertion space of the insulative housing; and a shell having a cavity defined in the shell and accommodating the insulative housing.

2. The electrical plug connector as claimed in claim 1, wherein the top board has multiple upper through holes defined through the top board and communicating with the insertion space;

the bottom board has multiple lower through holes defined through the bottom board and communicating with the insertion space;

an upper pressing element is mounted on the top board and has multiple upper resilient pressing tabs formed on the upper pressing element and respectively extending through the upper through holes into the insertion space; and a lower pressing element is mounted on the bottom board and has multiple lower resilient pressing tabs formed on the lower pressing element and respectively extending through the lower through holes into the insertion space.

3. The electrical plug connector as claimed in claim 2, wherein the insulative housing has an assembling slot defined in the rear end of the insulative housing;

the shielding-grounding plate has an extension shielding sheet formed on and protruding forward from the shielding body, mounted in the assembling slot of the insulative housing, and located between the mounting sections of the conductive terminals of the two terminal sets.

4. The electrical plug connector as claimed in claim 3, wherein the assembling slot has two opposite hooking notches defined respectively in two opposite inner walls of the assembling slots;

the shielding-grounding plate has two fastening elements formed and protruding forward from the shielding body and engaged respectively with the hooking notches.

5. The electrical plug connector as claimed in claim 4, wherein each fastening element of the shielding-grounding plate is located between the extension shielding sheet and one of the resilient hooking arms.

6. The electrical plug connector as claimed in claim 5, wherein two positioning slots are defined through the sidewalls and communicate with the insertion space; and the resilient hooking arms are mounted respectively in the positioning slots.

7. The electrical plug connector as claimed in claim 6, wherein the shielding body of the shielding-grounding plate has two mounting holes defined through the shielding body;

an upper rear plug bracket is mounted on the rear end of the insulative housing, is mounted above the shielding-grounding plate and has an upper mounting bracket;

an upper inserting board formed on and protruding forward from the upper mounting bracket and mounted in the assembling slot of the insulative housing; and an upper mounting protrusion formed on and protruding downward from the upper mounting bracket and mounted in one of the mounting holes of the shielding body of the shielding-grounding plate;

a lower rear plug bracket is mounted on the rear end of the insulative housing, is mounted under the shielding-grounding plate and has a lower mounting bracket;

a lower inserting board formed on and protruding forward from the lower mounting bracket and mounted in the assembling slot of the insulative housing; and a lower mounting protrusion formed on and protruding upward from the lower mounting bracket and mounted in the other mounting hole of the shielding body of the shielding-grounding plate.

8. The electrical plug connector as claimed in claim 7 further comprises a circuit board mounted on the rear end of the insulative housing and having two opposite surfaces respectively connected to the soldering sections of the conductive terminals of the two terminal sets by soldering, wherein one of the opposite surfaces is connected to the soldering tabs of the shielding-grounding plate by soldering.

9. The electrical plug connector as claimed in claim 8 further comprises an upper shielding cover and a lower shielding cover cooperating to cover the insulative housing, the terminal sets, the upper rear plug bracket, the lower rear plug bracket and the circuit board.

10. The electrical plug connector as claimed in claim 9, wherein the top board has multiple upper terminal recesses and multiple upper through holes defined in the upper inner surface of the top board;

the bottom board has multiple lower terminal recesses and multiple lower through holes defined in the lower inner surface of the bottom board; and the conductive terminals of one of the terminal sets are mounted respectively in the upper terminal recesses of the top board of the insulative housing, and the conductive terminals of the other terminal set are mounted respectively in the lower terminal recesses of the bottom board of the insulative housing.

11. The electrical plug connector as claimed in claim 10, wherein each terminal set is mounted in the top board or the bottom board of the insulative housing by an insert-molding process.

* * * * *